United States Patent [19]

Miller

[11] 4,368,844

[45] Jan. 18, 1983

[54] RAILROAD SUPPORT FABRIC

[75] Inventor: Donald F. Miller, Hendersonville, Tenn.

[73] Assignee: E. I. Du Pont de Nemours and Company, Wilmington, Del.

[21] Appl. No.: 308,995

[22] Filed: Oct. 6, 1981

[51] Int. Cl.[3] ..... E01B 1/00

[52] U.S. Cl. ..... 238/2; 428/300; 428/212; 428/220; 428/340

[58] Field of Search ..... 428/300, 298, 475.8; 104/2; 238/2; 404/27, 28

[56] References Cited

U.S. PATENT DOCUMENTS

| | | |
|---|---|---|
| 3,587,964 | 6/1971 | Cork . |
| 3,649,429 | 3/1971 | Hughes . |
| 4,265,398 | 5/1981 | Luebke . |

*Primary Examiner*—George F. Lesmes
*Assistant Examiner*—Beverly K. Johnson

[57] ABSTRACT

Railroad support fabric consisting essentially of three lamellae, two being of nonwoven polypropylene fibers, and the third being of nylon fibers, the nylon fiber lamella being sandwiched between the other lamellae, and railroad beds containing said support fabric.

9 Claims, 1 Drawing Figure

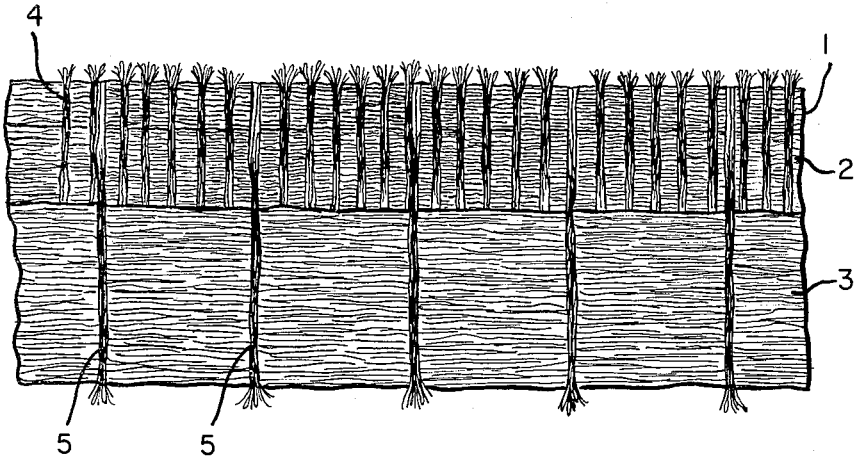
4
1
2
3
5
5

RAILROAD SUPPORT FABRIC

BACKGROUND OF THE INVENTION

This invention relates to a railroad support fabric, and to a railroad bed containing the support fabric. Railroad beds are subjected to high stress due to the great weight of rail traffic. Consequently considerable effort is put forth in building railroad beds so that they are able to withstand the stress over long periods of time with minimum maintenance. One factor that contributes to railroad bed instability and high maintenance costs is the inability to keep the ballast in its designated place, i.e. under, around and between the railroad ties. This factor becomes a serious problem when the railroad bed is laid in areas of high rainfall or in low-lying swampy areas, for the underlying earth support may become soft and the weight of the train will force the ballast into the earth support, or allow the earth support to be squeezed up into the voids of the ballast, or both. The present invention is a laminar construction especially designed to be placed under ballast rock and over the earthen support to keep the ballast rock from being pressed into the earthen support, and to keep the earthen support from being squeezed into the voids of the ballast aggregate.

SUMMARY OF THE INVENTION

The present invention is a laminar construction especially constructed for use as a geotextile support in a railroad bed. The present invention is also a railroad bed containing the especially constructed laminar construction.

The laminar construction of this invention consists essentially of three lamellae. The thickest lamella in the construction is composed of bonded nonwoven continuous polypropylene fibers. This lamella has a weight per square yard between about 6 and 18 oz (203 and 610 g/m$^2$), preferably about 9 oz/yd$^2$ (305 g/m$^2$). The polypropylene fibers have a denier of about 8 to 25, often about 10. Preferably the fibers in this lamella are aligned in perpendicular directions. Nonwoven polypropylene fabrics of this type can be made by the process disclosed in Edwards U.S. Pat. No. 3,563,838. It is also preferred that the filaments in this lamella be lubricated so that in the subsequent needling operation the needles will penetrate the fabric with minimum friction. Lubrication is also disclosed in the Edwards patent.

The second lamella in the laminar construction of this invention is composed of nylon fibers. This lamella has a weight per square yard of about 2 to 6 oz (68 to 203 g/m$^2$), preferably about 4 oz/yd$^2$ (136 g/m$^2$). In this lamella the nylon fibers are randomly arranged. The nylon fibers have an average length of about 0.8 to 3.5 inch (2 to 9 cm). The nylon fiber denier is not critical and may range from between about 1.5 and about 5. The nylon fiber lamella provides the desirable wicking property to the laminate, that aids in removing water from the railroad bed.

The third lamella in the laminate is like the first layer, bonded nonwoven continuous polypropylene fibers. This lamella, sometimes called the scrim, is preferably also made up of fibers that are aligned in perpendicular directions. This lamella has a weight per square yard between about 1 and 3 oz (34 and 102 g/m$^2$), preferably about 1.9 oz/sq yd (64 g/m$^2$).

In the laminate of the present invention the nylon fiber lamella is sandwiched between the two polypropylene fiber lamellae. The laminate has a total thickness of about 32 to 250 mils as measured by ASTM D-17777-64. In a preferred embodiment, the laminate has a thickness of 65 mils, of which 30 is one lamella of polypropylene, 7 is the other lamella of polypropylene and 28 is the nylon lamella. If desired, the three lamellae may themselves consist of fabric layers, for example the 30-mil thick polypropylene lamella could be made up of three 10-mil layers.

The FIGURE in the drawing is a cross sectional view, somewhat diagrammatic, of the laminate of the invention.

The laminate of the invention is held together by localized areas of penetrations of fibers of one lamella into and/or through another lamella. Such interlocking may be accomplished by means of needle punching. Such techniques are well known in the art. These localized areas of fiber penetration may vary from about 32 to 650 penetrations per square inch (5 to 100 per cm$^2$) in the laminates of the invention.

The railroad bed of the invention comprises a set of metal rails, mounted on railroad ties. The ties are supported on ballast, i.e. crushed rock, slag or the like, and the ballast is supported by earth. Between the ballast and the earth is located the laminate described above. The laminate is preferably located in the railroad bed with the thinner polypropylene fiber lamella next to the ballast layer. Preferably the laminate is under the full width of the road bed.

DETAILED DESCRIPTION

In the FIGURE, a bonded nonwoven continuous polypropylene fiber sheet 1, is shown to be held to a layer of nylon fibers 2 by localized areas of penetrations of fibers 4 into and/or through the polypropylene fiber sheet 1. A thicker layer of bonded, nonwoven continuous polypropylene fiber 3 is shown to be held to the lamella of nylon fiber by localized areas of penetration of fibers 5 into and/or through the polypropylene fiber lamella.

EXAMPLE

Two lubricated, bonded, nonwoven polypropylene sheets having the filaments substantially aligned in perpendicular directions were prepared as taught in Edwards U.S. Pat. No. 3,563,838 and as illustrated in FIG. 5 thereof. One sheet (lamella), called the base fabric, weighs 9 oz/yd$^2$ (305 g/m$^2$) and consists of four layers of polypropylene filaments. The filaments of the first two layers are arranged substantially in the same direction and the filaments of the other two layers are arranged in a substantially perpendicular direction in the plane of the sheet. Each layer has an average denier per filament of about 10.

The second sheet (lamella), called a scrim, weighs 2.5 oz/yd$^2$ (85 g/m$^2$) and also consists of four layers of polypropylene filaments. The filaments of the two outer layers are arranged substantially in the same direction and are about 10 denier per filament. The filaments of the two inner layers are arranged in a substantially perpendicular direction in the plane of the sheet and are about 20 denier per filament.

A uniform web or batt (lamella) of nylon staple fibers of random length was combined with the scrim by needling. The batt was made from nylon staple of mixed denier (averaging 3 denier per filament), which was garnetted and cut to an average length of 1½ inches (4 cm). The batt weighing 3.5 oz/yd$^2$ (119 g/m$^2$) was deposited on the scrim by air-laying web-forming equipment, and the two components were passed through a needle loom equipped with 36-gauge tapered needles. The nylon batt was on top of the scrim. The needles initially entered through the nylon batt. The rate of needling was controlled to effect 400 penetrations per square inch (62 per square cm). The needled scrim/batt assembly is designated as "A" in the table below.

The scrim/batt assembly was next superimposed on the base fabric, the batt side thereof being adjacent the base fabric. The entire assembly was then passed through a needle loom equipped with 20-gauge triangular needles under conditions of 60 penetrations per square inch (9.3 per square cm). The needles initially entered through the scrim layer. There resulted a composite fabric in which the nylon staple batt was sandwiched between the polypropylene base fabric and the polypropylene scrim, some of the nylon fibers in the central layer extending through the needle holes to and beyond the outer surfaces of the base fabric and scrim.

Samples of the composite fabric and the two components from which it was made (base fabric and scrim/-batt) were each submitted to a durability test in the laboratory under conditions designed to simulate the forces exerted on a railroad support fabric. The test method is described in the next paragraph, and the results are listed in the table below. In the table sample "A" is the needled scrim/batt assembly, and "B" is the base fabric needled at 60 penetrations per square inch.

The test device consisted of a small pot 6 inches (15 cm) in diameter filled with soft clay (California Bearing Ratio approximately equal to 1) over which was placed the fabric to be tested. In testing the fabric of the invention the base fabric layer was placed on the clay. The central portion of the fabric was repeatedly struck by the base of a cylinder 3⅝ inches (9.2 cm) in diameter, which carries on its impact face an adhered layer of standard railroad ballast. The force of impact is adjusted to provide an average pressure on the fabric of 155 lb/in$^2$ (1069 kilopascals), which represents the pressure found in actual use about 4–5 inches below a railroad tie when a railroad car passes on the rails above. The cylinder is pneumatically driven to strike the fabric 122 times per minute, and the number of cycles until the stones penetrate the fabric is counted and recorded.

The results listed in the following table are an average of 3 tests on samples of each fabric, the individual test results being within 15% of the average value.

TABLE

| Sample | Cycles to Failure |
|---|---|
| A | 508 |
| B | 1,743 |
| Composite | 197,000 |

Surprisingly, the durability of the composite is more than 87 times the value of 2,251 cycles expected by combining samples "A" and "B".

I claim:

1. A laminar construction suitable for use as a geotextile support in a railroad bed consisting essentially of (1) a lamella of bonded nonwoven polypropylene fibers having a weight per square yard between about 6 and 18 oz, (2) a lamella of nylon fibers having a weight per square yard between about 2 and 6 oz, (3) and a lamella of bonded nonwoven polypropylene fibers having a weight per square yard between about 1 to 3 oz, said nylon lamella being located between said bonded nonwoven polypropylene fiber lamellae, said laminar construction being held together by localized areas of penetrations of fibers of one lamella into and/or through another, said laminar construction having a thickness of between 32 and 250 mils.

2. The laminar construction of claim 1 in which the polypropylene fiber lamellae are made up of fibers having a denier of 8 to 25.

3. The laminar construction of claim 2 in which the nylon fiber lamellae is made up of fibers having a denier of 1.5 to 5.

4. The laminar construction of claim 1 in which one of the polypropylene fiber lamellae weighs about 9 oz per square yard, and the other weighs about 1.9 oz square yard, and in which the nylon lamella weighs about 3.5 oz per square yard.

5. The laminar construction of claim 1 in which most of the polypropylene fibers are aligned in perpendicular directions.

6. The laminar construction of claim 1 in which the nylon fibers are randomly arranged in the plane of the nylon fiber lamella.

7. The laminar construction of claim 6 in which the nylon fibers have an average length in the range of 0.8 to 3.5 inches.

8. The laminar construction of claim 1 in which there are per square inch between 32 and 650 localized areas of penetrations of fibers of one lamella into and/or through another.

9. In a railroad bed which comprises a set of metal rails, mounted on railroad ties, said ties being supported by ballast, and said ballast being supported by earth, the improvement which comprises the laminate of claim 1 located between the ballast and the earth.

* * * * *